US011099510B2

(12) United States Patent
Kajiyama

(10) Patent No.: US 11,099,510 B2
(45) Date of Patent: Aug. 24, 2021

(54) PRESSER, FIXING DEVICE, AND IMAGE FORMING APPARATUS

(71) Applicant: Hiroshi Kajiyama, Tokyo (JP)

(72) Inventor: Hiroshi Kajiyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/892,629

(22) Filed: Jun. 4, 2020

(65) Prior Publication Data

US 2021/0018867 A1 Jan. 21, 2021

(30) Foreign Application Priority Data

Jul. 17, 2019 (JP) ..... JP2019-131623
May 11, 2020 (JP) ..... JP2020-083330

(51) Int. Cl.
*G03G 15/20* (2006.01)

(52) U.S. Cl.
CPC ..... *G03G 15/2064* (2013.01); *G03G 15/2032* (2013.01); *G03G 15/2035* (2013.01)

(58) Field of Classification Search
CPC ..... G03G 15/2064; G03G 15/2032; G03G 15/2035
See application file for complete search history.

(56) References Cited

U.S. PATENT DOCUMENTS

2006/0002737 A1* 1/2006 Shinshi ..... G03G 15/2035 399/122
2008/0310895 A1* 12/2008 Masuda ..... G03G 15/2064 399/331
2009/0148204 A1* 6/2009 Yoshinaga ..... G03G 15/2035 399/328
2020/0033764 A1 1/2020 Kajiyama et al.

FOREIGN PATENT DOCUMENTS

JP 2003223075 A 8/2003
JP 2018045194 A 3/2018

* cited by examiner

*Primary Examiner* — Walter L Lindsay, Jr.
*Assistant Examiner* — Laura Roth
(74) *Attorney, Agent, or Firm* — Harness, Dickey & Pierce, P.L.C.

(57) ABSTRACT

A presser presses a pressed object and includes a first rotation shaft and a pressurizing portion that is supported by the first rotation shaft and pivots about the first rotation shaft. A depressurizing portion is supported by a second rotation shaft and pivots about the second rotation shaft with respect to the pressurizing portion. The depressurizing portion includes an engagement. An interlock lever includes an opening that engages the engagement. The depressurizing portion pivots to switch between a pressurization state in which the engagement contacts and presses the opening to cause the pressurizing portion to press the pressed object and a depressurization state in which the pressurization state is released. The depressurizing portion pivots to define a gap between the engagement and the opening in a moving direction in which the engagement moves.

18 Claims, 11 Drawing Sheets

PRESSER, FIXING DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2019-131623, filed on Jul. 17, 2019, and 2020-083330, filed on May 11, 2020, in the Japan Patent Office, the entire disclosure of each of which is hereby incorporated by reference herein.

BACKGROUND

Technical Field

Exemplary aspects of the present disclosure relate to a presser, a fixing device, and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device that fixes a toner image formed on a recording medium thereon under heat and pressure. The fixing device employs nip formers, such as a pair of rollers, that sandwich the recording medium to heat and press the recording medium.

SUMMARY

This specification describes below an improved presser. In one embodiment, the presser presses a pressed object and includes a first rotation shaft and a pressurizing portion that is supported by the first rotation shaft and pivots about the first rotation shaft. A depressurizing portion is supported by a second rotation shaft and pivots about the second rotation shaft with respect to the pressurizing portion. The depressurizing portion includes an engagement. An interlock lever includes an opening that engages the engagement. The depressurizing portion pivots to switch between a pressurization state in which the engagement contacts and presses the opening to cause the pressurizing portion to press the pressed object and a depressurization state in which the pressurization state is released. The depressurizing portion pivots to define a gap between the engagement and the opening in a moving direction in which the engagement moves.

This specification further describes an improved fixing device. In one embodiment, the fixing device includes a first nip former and a second nip former disposed opposite the first nip former to form a fixing nip between the first nip former and the second nip former, through which a recording medium bearing an image is conveyed. The fixing device further includes a presser that presses at least one of the first nip former and the second nip former. The presser includes a first rotation shaft and a pressurizing portion that is supported by the first rotation shaft and pivots about the first rotation shaft. A depressurizing portion is supported by a second rotation shaft and pivots about the second rotation shaft with respect to the pressurizing portion. The depressurizing portion includes an engagement. An interlock lever includes an opening that engages the engagement. The depressurizing portion pivots to switch between a pressurization state in which the engagement contacts and presses the opening to cause the pressurizing portion to press the at least one of the first nip former and the second nip former and a depressurization state in which the pressurization state is released. The depressurizing portion pivots to define a gap between the engagement and the opening in a moving direction in which the engagement moves.

This specification further describes an improved image forming apparatus. In one embodiment, the image forming apparatus includes an image bearer that bears an image and a fixing device that fixes the image on a recording medium. The fixing device includes a first nip former and a second nip former disposed opposite the first nip former to form a fixing nip between the first nip former and the second nip former, through which the recording medium bearing the image is conveyed. The fixing device further includes the presser described above that presses at least one of the first nip former and the second nip former.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
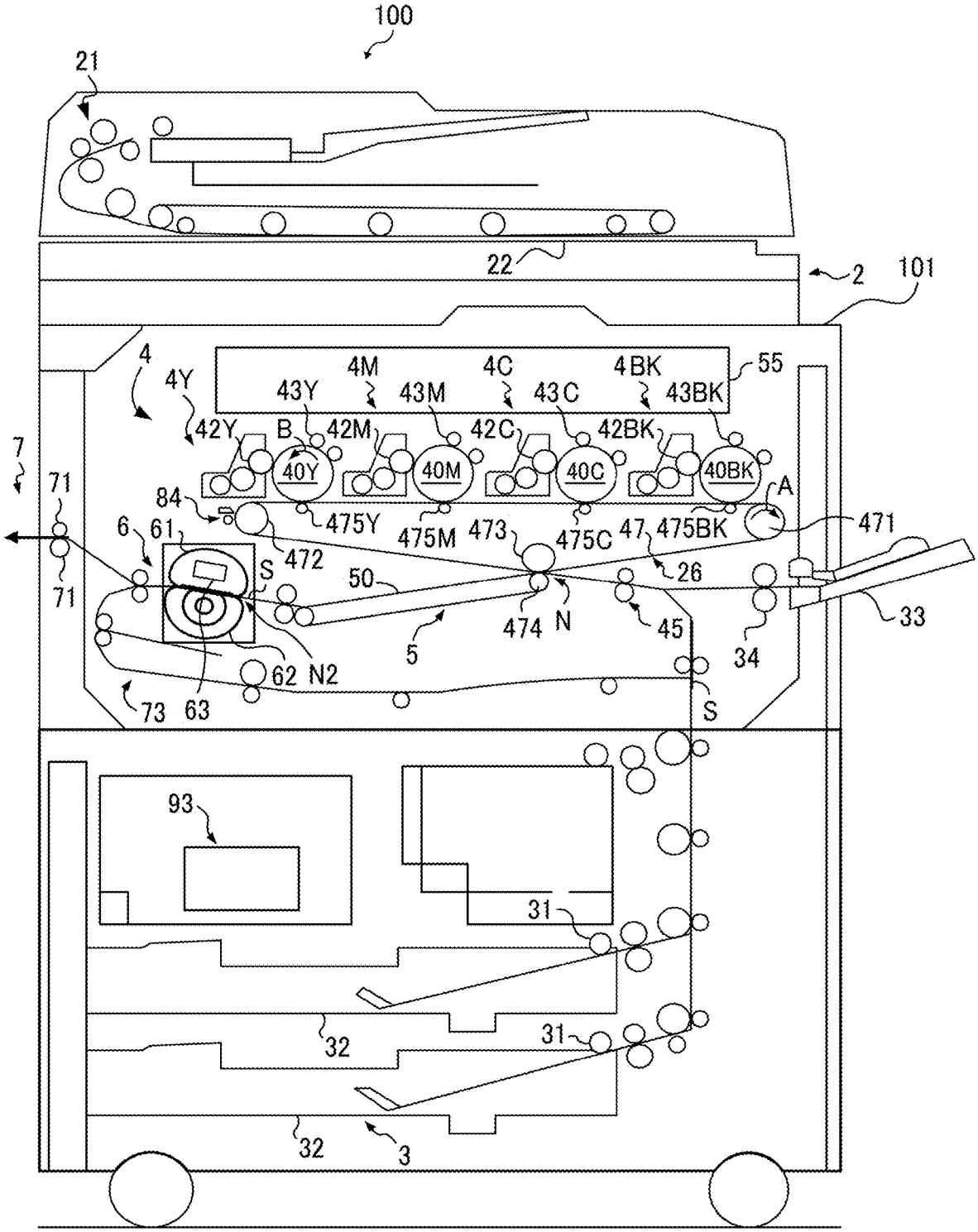
FIG. 1 is a schematic cross-sectional view of an image forming apparatus according to an embodiment of the present disclosure, that incorporates a fixing device.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

FIG. 1 schematically illustrates a construction of an image forming apparatus 100 as one example of embodiments of the present disclosure.

The image forming apparatus 100 includes a fixing device 6 according to an embodiment of the present disclosure. The image forming apparatus 100 forms an image on a sheet S as one example of recording media with toner serving as a recording agent by copying, printing, and the like.

As illustrated in FIG. 1, the image forming apparatus 100 includes an image forming device 4 and a sheet feeding device 3. The image forming device 4 forms a toner image on a sheet S serving as a recording medium and includes four process units 4Y, 4M, 4C, and 4BK. The sheet feeding device 3 supplies the sheet S to the image forming device 4.

The image forming apparatus 100 further includes a reading device 2 serving as a scanner that reads an image on an original and an auto document feeder 21 that feeds the original to the reading device 2 automatically.

The image forming apparatus 100 further includes a transfer unit 26 and an optical scanner 55 that are disposed inside a body 101. The transfer unit 26 serves as a transferor including an endless, intermediate transfer belt 47 serving as a transfer body. The optical scanner 55 serves as an exposure device disposed in proximity to the image forming device 4.

The image forming apparatus 100 further includes a transfer-convey device 5 serving as a secondary transferor that conveys the sheet S and transfers a toner image borne on the intermediate transfer belt 47 onto the sheet S at a secondary transfer nip N formed between the intermediate transfer belt 47 and the transfer-convey device 5 in a secondary transfer process.

The image forming apparatus 100 further includes an intermediate transfer belt cleaner 84 that cleans the intermediate transfer belt 47 after the secondary transfer process.

The image forming apparatus 100 further includes a registration roller pair 45 that feeds the sheet S supplied from the sheet feeding device 3 to the secondary transfer nip N at a predetermined time.

The image forming apparatus 100 further includes the fixing device 6 that fixes the toner image on the sheet S which is conveyed by a conveyance belt 50 of the transfer-convey device 5 and bears the toner image transferred while the sheet S passes through the secondary transfer nip N.

The image forming apparatus 100 further includes a sheet ejector 7 that ejects the sheet S which bears the fixed toner image and has passed through the fixing device 6 onto an outside of the body 101.

The image forming apparatus 100 further includes an image forming controller 93 serving as a controller that controls operations of the components described above. The image forming controller 93 is installed with a central processing unit (CPU), a nonvolatile memory, and a volatile memory.

The auto document feeder 21 conveys the original onto an exposure glass 22. The reading device 2 optically reads the image on the original placed on the exposure glass 22, creating image data of red (R), green (G), and blue (B). For example, the reading device 2 emits light onto the original. A reading sensor such as a charge coupled device (CCD) and a contact image sensor (CIS) receives the light reflected by the original, reading the image on the original into the image data of RGB. The image data of RGB is information defining a toner image to be formed on a sheet S and contains the brightness of each of red (R), green (G), and blue (B).

The sheet feeding device 3 includes a plurality of sheet trays 32 (e.g., paper trays) and a plurality of sheet feeding rollers 31. Each of the sheet trays 32 is disposed inside the body 101 and loads sheets S. Each of the sheet feeding rollers 31 picks up and conveys a sheet S stored in the sheet tray 32 toward the registration roller pair 45.

The sheet feeding device 3 further includes a bypass sheet feeding device 33 (e.g., a bypass tray) and a bypass sheet feeding roller 34. The bypass sheet feeding device 33 serves as a bypass sheet feeder that supplies a sheet S from the outside of the body 101. The bypass sheet feeding roller 34 conveys the sheet S from the bypass sheet feeding device 33 toward the registration roller pair 45.

The process units 4Y, 4M, 4C, and 4BK include drum-shaped photoconductors 40Y, 40M, 40C, and 40BK serving as image bearers and rotators, respectively, that rotate counterclockwise in FIG. 1 in a rotation direction B. Each of the photoconductors 40Y, 40M, 40C, and 40BK includes a photoconductive layer serving as a surface layer and a scanned face scanned by light emitted by the optical scanner 55.

The process units 4Y, 4M, 4C, and 4BK further include chargers 43Y, 43M, 43C, and 43BK disposed opposite the photoconductors 40Y, 40M, 40C, and 40BK at upstream positions in the rotation direction B, respectively.

The process units 4Y, 4M, 4C, and 4BK further include developing devices 42Y, 42M, 42C, and 42BK serving as developing means and primary transfer rollers 475Y, 475M, 475C, and 475BK serving as primary transferors disposed in the transfer unit 26, respectively.

The process units 4Y, 4M, 4C, and 4BK further include electric potential sensors, that is, surface electric potential sensors serving as surface electric potential detectors that detect the surface electric potential of the photoconductors 40Y, 40M, 40C, and 40BK, respectively.

As the optical scanner 55 forms latent images on the photoconductors 40Y, 40M, 40C, and 40BK, the process units 4Y, 4M, 4C, and 4BK visualize the latent images into yellow, magenta, cyan, and black toner images, respectively.

The intermediate transfer belt 47 is made of polyimide resin that is barely stretched and dispersed with carbon powder to adjust the electric resistance. The intermediate transfer belt 47 is looped over a driving roller 471, a driven roller 472, and a secondary transfer roller 473. A driver drives and rotates the driving roller 471 clockwise in FIG. 1 in a rotation direction A. The driven roller 472 and the secondary transfer roller 473 rotate clockwise in FIG. 1 like the driving roller 471.

The transfer-convey device 5 includes a secondary transfer opposed roller 474 disposed opposite the secondary transfer roller 473.

The secondary transfer opposed roller 474 of the transfer-convey device 5 contacts the intermediate transfer belt 47, forming the secondary transfer nip N therebetween.

While the secondary transfer opposed roller 474 of the transfer-convey device 5 and the secondary transfer roller 473 sandwich the intermediate transfer belt 47 and the sheet S at the secondary transfer nip N, the secondary transfer roller 473 applies a secondary transfer bias to transfer the yellow, magenta, cyan, and black toner images formed on a surface of the intermediate transfer belt 47 onto the sheet S.

The secondary transfer bias has an electric charge having a polarity opposite a polarity of an electrostatic charge with which the surface of the intermediate transfer belt 47 is charged.

The sheet ejector 7 includes a pair of sheet ejection rollers 71 and a duplex unit 73. The sheet ejection rollers 71 are disposed opposite each other. The duplex unit 73 reverses the sheet S and conveys the sheet S to the registration roller pair 45 for duplex printing to form toner images on both sides of the sheet S, respectively.

The image forming controller 93 is a computer including the CPU, a main memory (e.g., a memory for printing (MEM-P)), a northbridge (NB), and a southbridge (SB).

The image forming controller 93 further includes an accelerated graphics port (AGP) bus, an application specific integrated circuit (ASIC), and a local memory (e.g., a memory for copying (MEM-C)).

The image forming controller 93 further includes a hard disk (HD), a hard disk drive (HDD), a peripheral component interconnect (PCI) bus, and a network interface (I/F).

The CPU performs processing and calculation on data and controls operations of the components described above according to a program stored in the main memory. The main memory works as a memory area of the image forming controller 93 and stores programs and data that achieve functions of the image forming controller 93. Alternatively, the programs may be recorded in recording media, such as a compact disc read only memory (CD-ROM), a floppy disk (FD), a compact disc-recordable (CD-R), and a digital versatile disc (DVD), that are readable by a computer in files in formats installable or executable.

The local memory (e.g., MEM-C) is used as a copy image buffer and a code buffer. The HD is a storage that stores image data, font data used for printing, and forms. The HDD controls reading or writing of data with respect to the HD according to a control of the CPU. The network OF sends and receives information to and from an external device such as an information processing apparatus via a communication network.

The image forming controller 93 operates as a communication controller that controls interactive communication with a host device (e.g., a personal computer) via the communication network or the like.

The image forming controller 93 also operates as an image data processor that sends image data sent from the host device to the optical scanner 55.

The fixing device 6 includes a first fixing rotator 61 (e.g., a pressure roller) serving as a first nip former, a second fixing rotator 62 (e.g., a fixing belt) serving as a second nip former, and a heater 63. The first fixing rotator 61 conveys the sheet S. The second fixing rotator 62 contacts the first fixing rotator 61 to form a fixing nip N2 therebetween. The heater 63 serving as a heat source heats the first fixing rotator 61 so that the first fixing rotator 61 heats and fixes the toner image on the sheet S. For example, according to this embodiment, the first fixing rotator 61 and the second fixing rotator 62 serve as a pair of nip formers disposed opposite each other.

Alternatively, the heater 63 may be installed inside the second fixing rotator 62. According to this embodiment, the heater 63 is installed inside the first fixing rotator 61.

A detailed description is provided of a construction of the fixing device 6.

Figure 2:
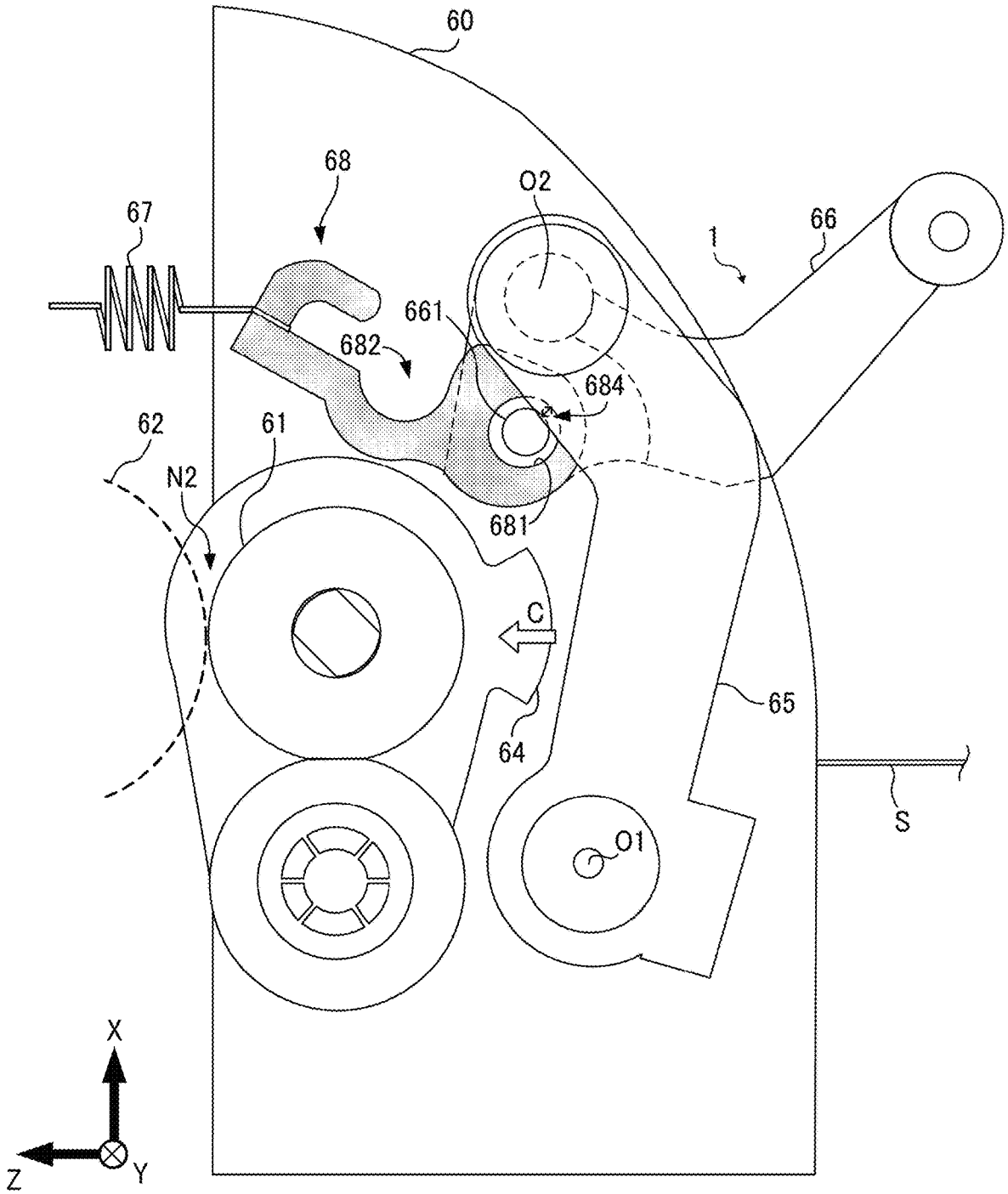
FIG. 2 is a partial cross-sectional view of the fixing device depicted in FIG. 1, illustrating a presser incorporated therein.

As illustrated in FIG. 2 and following drawings, an X-direction denotes a sheet conveyance direction of the sheet S. AY-direction denotes an axial direction of each of the first fixing rotator 61 and the second fixing rotator 62. A Z-direction denotes a direction perpendicular to the X-direction and the Y-direction.

As illustrated in FIG. 2, the fixing device 6 includes a pressure body 64 and a presser 1 that includes a pressure arm 65. The pressure body 64 is mounted on the first fixing rotator 61 and presses the first fixing rotator 61. The pressure arm 65 is supported by a first rotation shaft O1 such that the pressure arm 65 is pivotable about the first rotation shaft O1. The pressure arm 65 serves as a pressurizing portion that presses the pressure body 64 in a direction C, thus pressing the first fixing rotator 61.

The presser 1 of the fixing device 6 further includes a depressure lever 66 and a spring 67. The depressure lever 66 serves as a depressurizing portion that contacts the pressure arm 65 and is supported by a second rotation shaft O2 such that the depressure lever 66 is pivotable about the second rotation shaft O2 with respect to the pressure arm 65. One end of the spring 67 serving as a resilient member is secured to a case 60 serving as a stationary housing of the fixing device 6.

The presser 1 of the fixing device 6 further includes an interlock lever 68 (e.g., a lock lever) that is anchored to another end of the spring 67 and engaged with the second rotation shaft O2 and the depressure lever 66 such that the interlock lever 68 is supported movably.

Figure 3A:
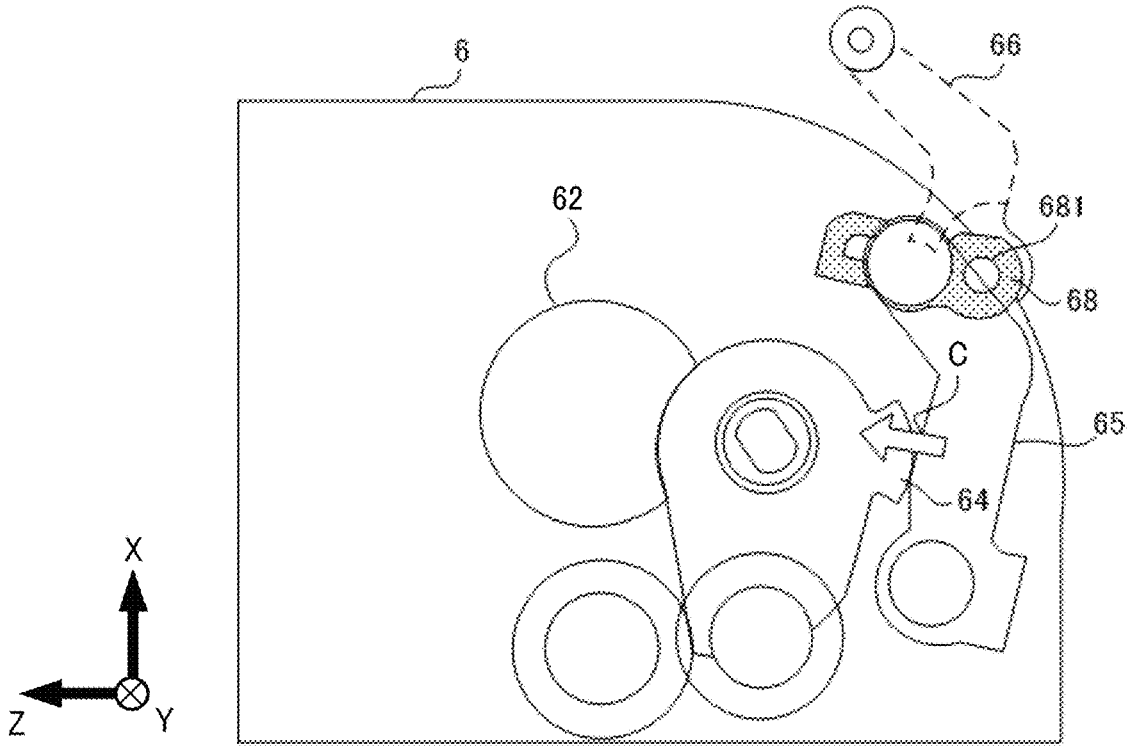
FIG. 3A is a cross-sectional view of the fixing device depicted in FIG. 1 as one example.
Figure 3B:
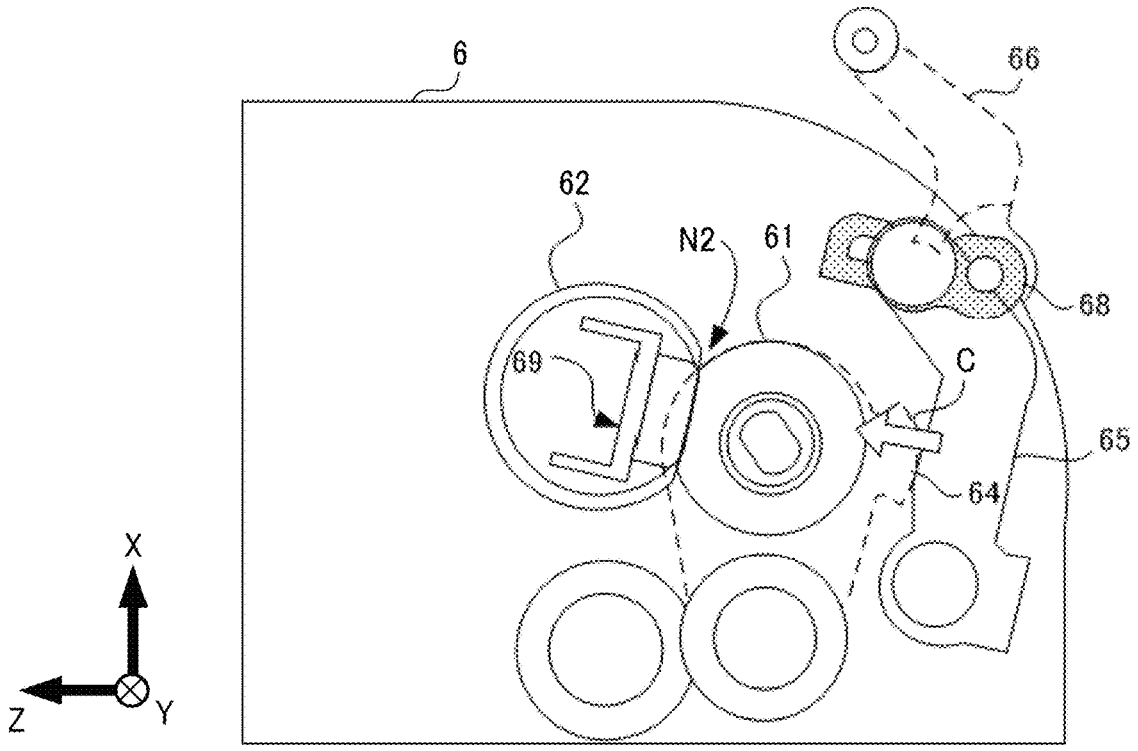
FIG. 3B is a cross-sectional view of the fixing device depicted in FIG. 1, illustrating a nip formation pad incorporated therein.

For example, according to the embodiments, as illustrated in FIGS. 3A and 3B, as the pressure arm 65 presses the pressure body 64 in the direction C, the pressure body 64 presses the first fixing rotator 61, that is, the pressure roller, against a nip formation pad 69 disposed inside the second fixing rotator 62. Thus, the presser 1 presses one of the pair of nip formers which forms the fixing nip N2, that is, the first fixing rotator 61. According to the embodiments, the direction C is perpendicular to the X-direction. However, the fixing device 6 may employ other constructions.

As illustrated in FIG. 2, the second rotation shaft O2 supports the depressure lever 66 such that the depressure lever 66 is pivotable about the second rotation shaft O2. The depressure lever 66 includes a projection 661 serving as an engagement that engages an opening 681 (e.g., a hole) of the interlock lever 68.

Figure 4A:
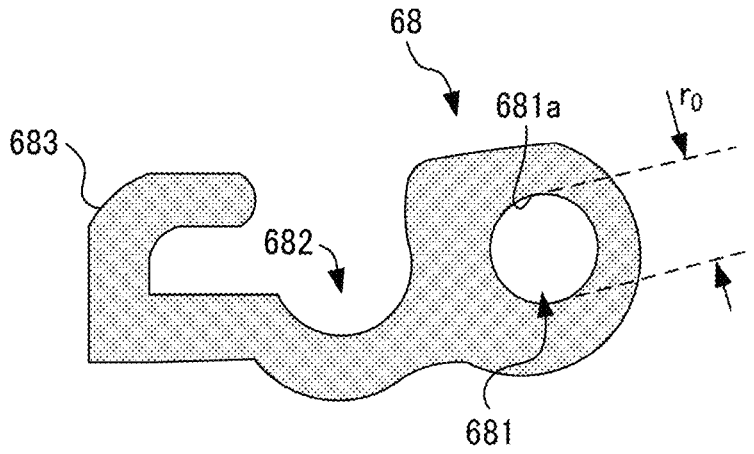
FIG. 4A is a cross-sectional view of an interlock lever incorporated in the presser depicted in FIG. 2.
Figure 4B:
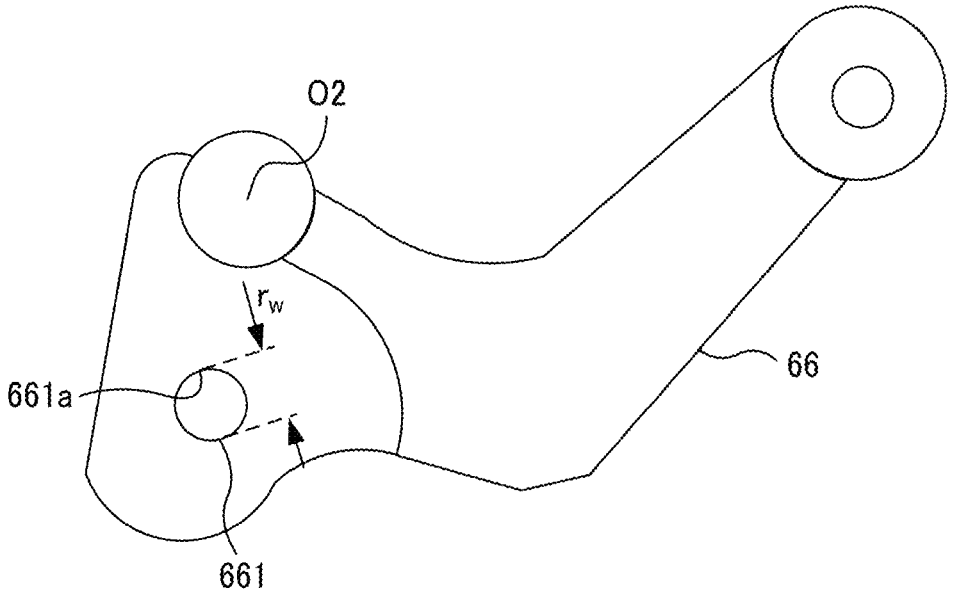
FIG. 4B is a cross-sectional view of a depressure lever incorporated in the presser depicted in FIG. 2.

As illustrated in FIGS. 4A and 4B, the interlock lever 68 includes the opening 681, a recess 682, and a hook 683. The opening 681 is greater than the projection 661. The recess 682 engages the second rotation shaft O2 as the depressure lever 66 pivots. The hook 683 extends from the recess 682 and is hooked with the spring 67.

According to this embodiment, the opening 681 defines a circle of which inner diameter is greater than a diameter of the projection 661. The configuration of the opening 681 is not limited to the above. For example, as illustrated in FIGS. 4A and 4B, the opening 681 may have other configurations in which a width $r_0$ of a decreased width portion 681*a* of the opening 681 is greater than a width $r_w$ of an increased width portion 661*a* of the projection 661, that engages the opening 681. For example, the decreased width portion 681*a* is a portion of the opening 681, that has the width $r_0$ smaller than a width of other portion of the opening 681. The increased width portion 661*a* is a portion of the projection 661, that has the width $r_w$ greater than a width of other portion of the projection 661, that engages the opening 681.

A description is provided of a case in which a sheet S is jammed inside the fixing device 6 while the sheet S is conveyed through the fixing device 6.

The case 60 depicted in FIG. 2 as a cover of the fixing device 6 is opened and closed by an operator (e.g., a user and a service engineer). If the sheet S is sandwiched between the first fixing rotator 61 and the second fixing rotator 62 and jammed at the fixing nip N2, the operator opens the case 60, releases the depressure lever 66 to decrease pressure exerted to the fixing nip N2, and removes the sheet S from the fixing nip N2.

A description is provided of a construction of a comparative fixing device.

If a recording medium (e.g., a sheet) is jammed between a pair of nip formers while the recording medium is conveyed, for example, in order to facilitate removal of the recording medium, pressurization of a presser that presses at least one of the nip formers is released. Thus, the presser transits from a pressurization state in which the presser presses the nip former with an increased pressure to a depressurization state in which the presser presses the nip former with a decreased pressure or contacts the nip former with no pressure.

However, since the nip formers of the comparative fixing device sandwich the recording medium with an increased pressure, a substantial force corresponding to the increased pressure is exerted to the presser to switch between the pressurization state and the depressurization state.

Figure 5:
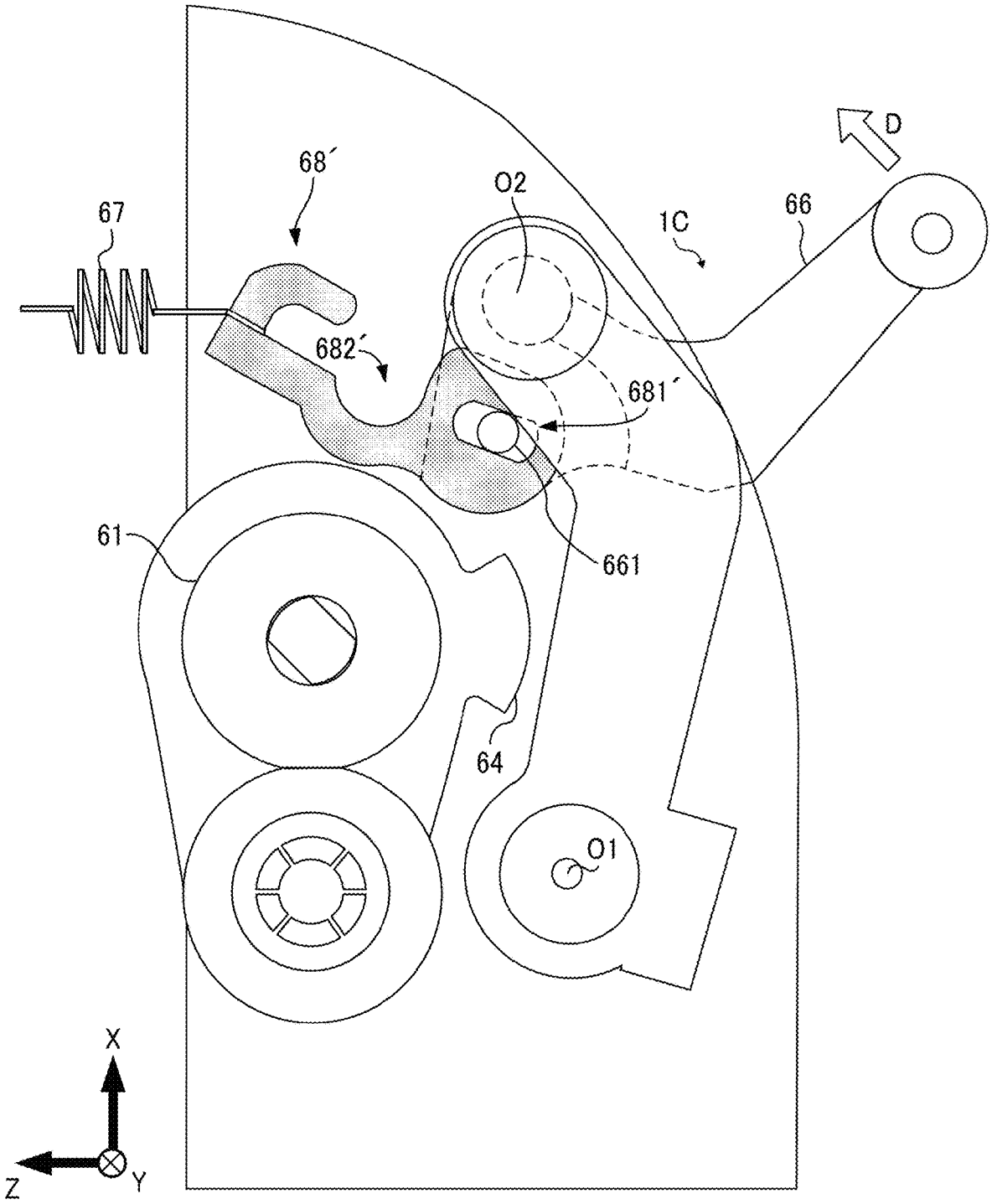
FIG. 5 is a cross-sectional view of a comparative presser, illustrating one example of a depressurization state.

Prior to a description of operations of the fixing device 6 according to the embodiments of the present disclosure when the sheet S is jammed, a description is provided of a construction of a comparative presser 1C with reference to FIG. 5.

As illustrated in FIG. 5, the comparative presser 1C includes an interlock lever 68' including an opening 681' that engages the projection 661. The opening 681' is an elongated hole, not a circular hole.

Figure 6:
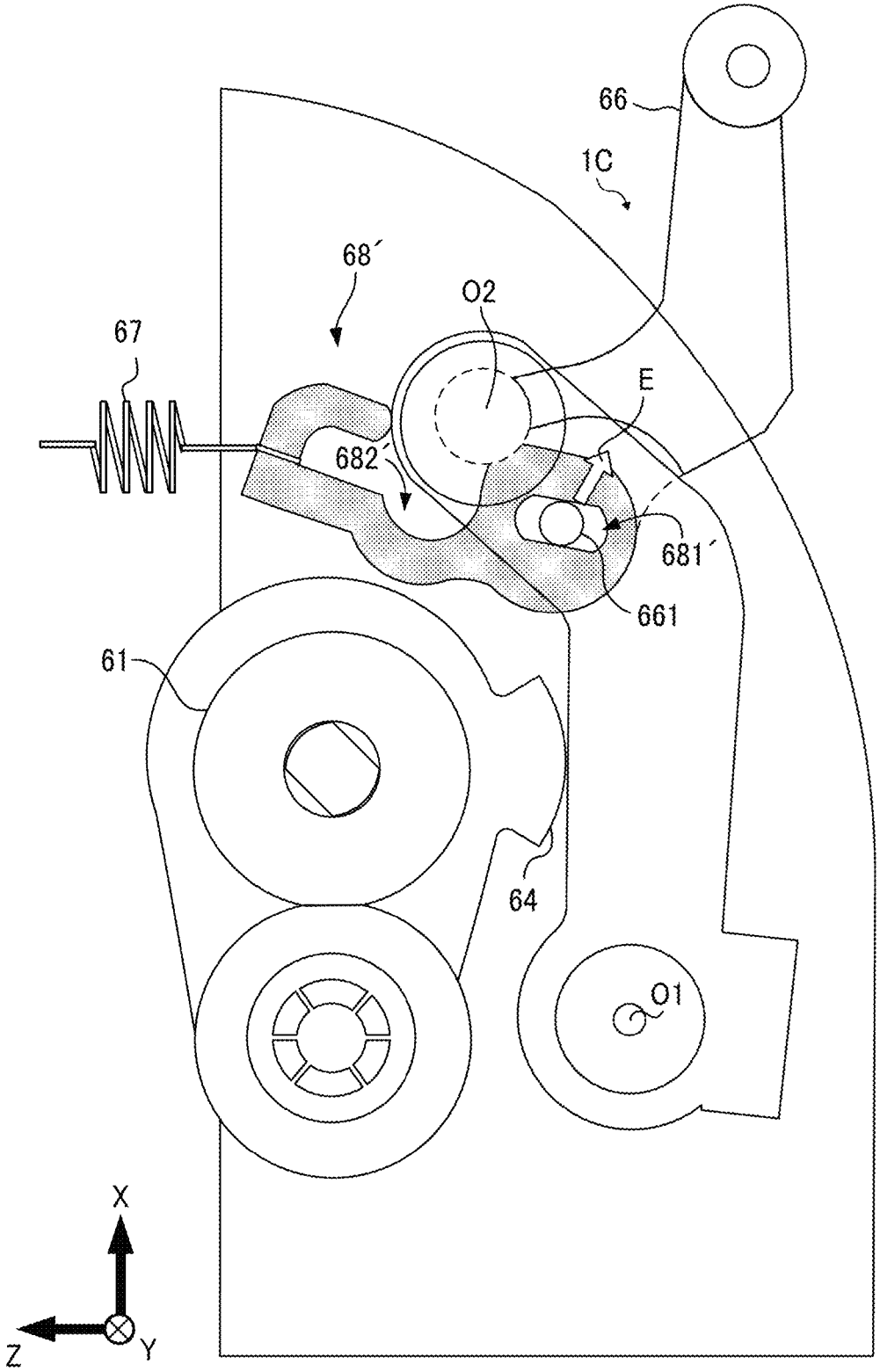
FIG. 6 is a cross-sectional view of the comparative presser depicted in FIG. 5, illustrating one example of transition from the depressurization state to a pressurization state.

In the comparative presser 1C, as the depressure lever 66 moves in a direction D as illustrated in FIG. 5, while the second rotation shaft O2 moves to engage a recess 682', the opening 681' and the projection 661 receive a force directed in a direction E as illustrated in FIG. 6.

The elongated hole of the opening 681' extends in a direction different from the direction E in which the force is exerted to the opening 681' and the projection 661. Accordingly, the slide resistance between the opening 681' and the projection 661 that slides over the opening 681' increases. Consequently, a force that moves the depressure lever 66 in the direction D depicted in FIG. 5 increases relatively.

To address this circumstance, the presser 1 according to the embodiments of the present disclosure has the construction depicted in FIG. 2, decreasing the force that moves the depressure lever 66.

The following describes operations of the depressure lever 66 specifically.

As illustrated in FIG. 2, in the fixing device 6 according to this embodiment, the second rotation shaft O2 about which the depressure lever 66 pivots does not engage the recess 682 in a depressurization state. As illustrated in FIGS. 4A and 4B, the width $r_0$ of the decreased width portion 681*a* of the opening 681 is greater than the width $r_w$ of the increased width portion 661*a* of the projection 661, that engages the opening 681. Accordingly, as illustrated in FIG. 2, a gap 684 is produced between an inner circumferential wall of the opening 681 and the projection 661.

Figure 7:
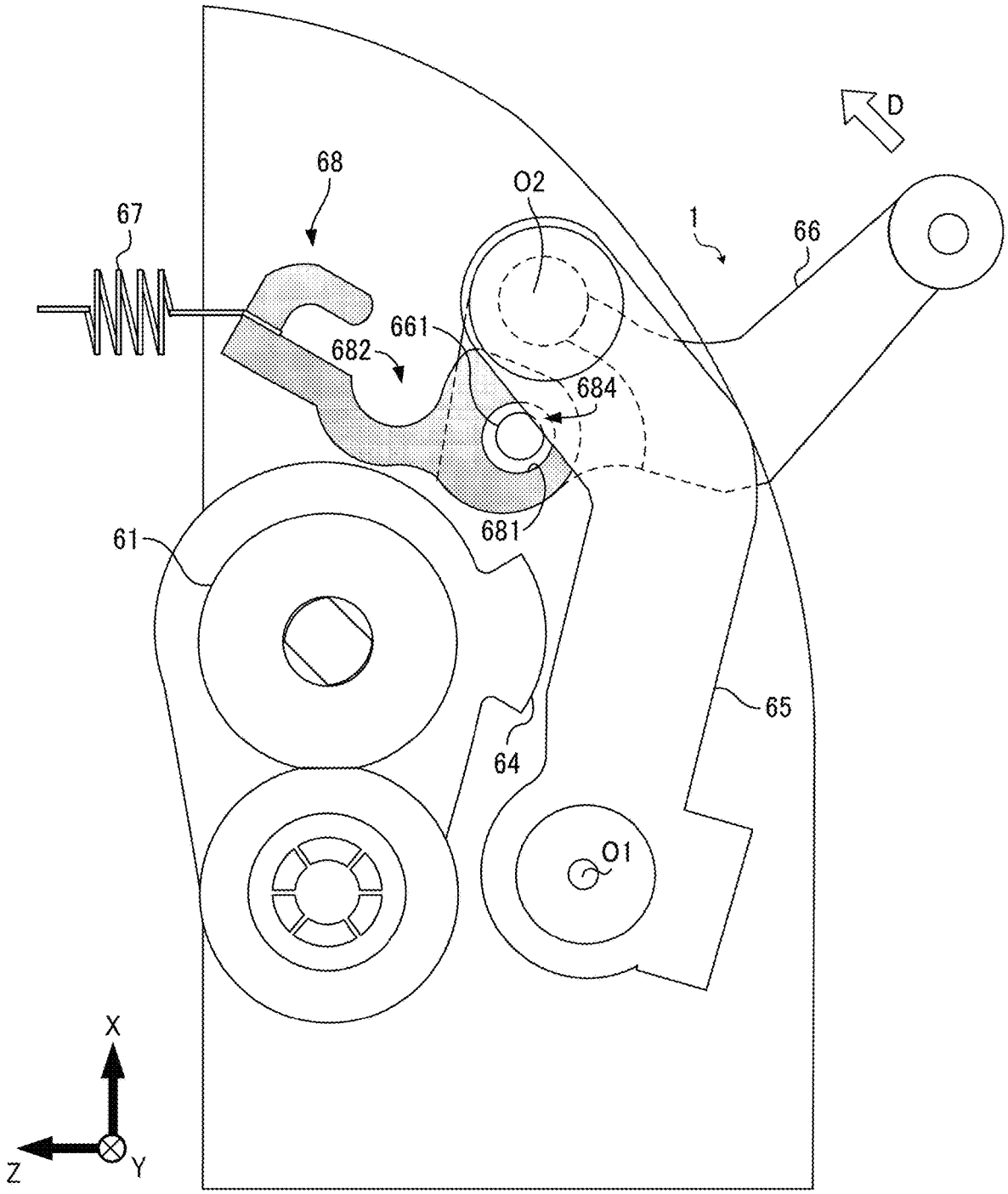
FIG. 7 is a cross-sectional view of the presser depicted in FIG. 2, illustrating one example of the depressurization state.
Figure 8:
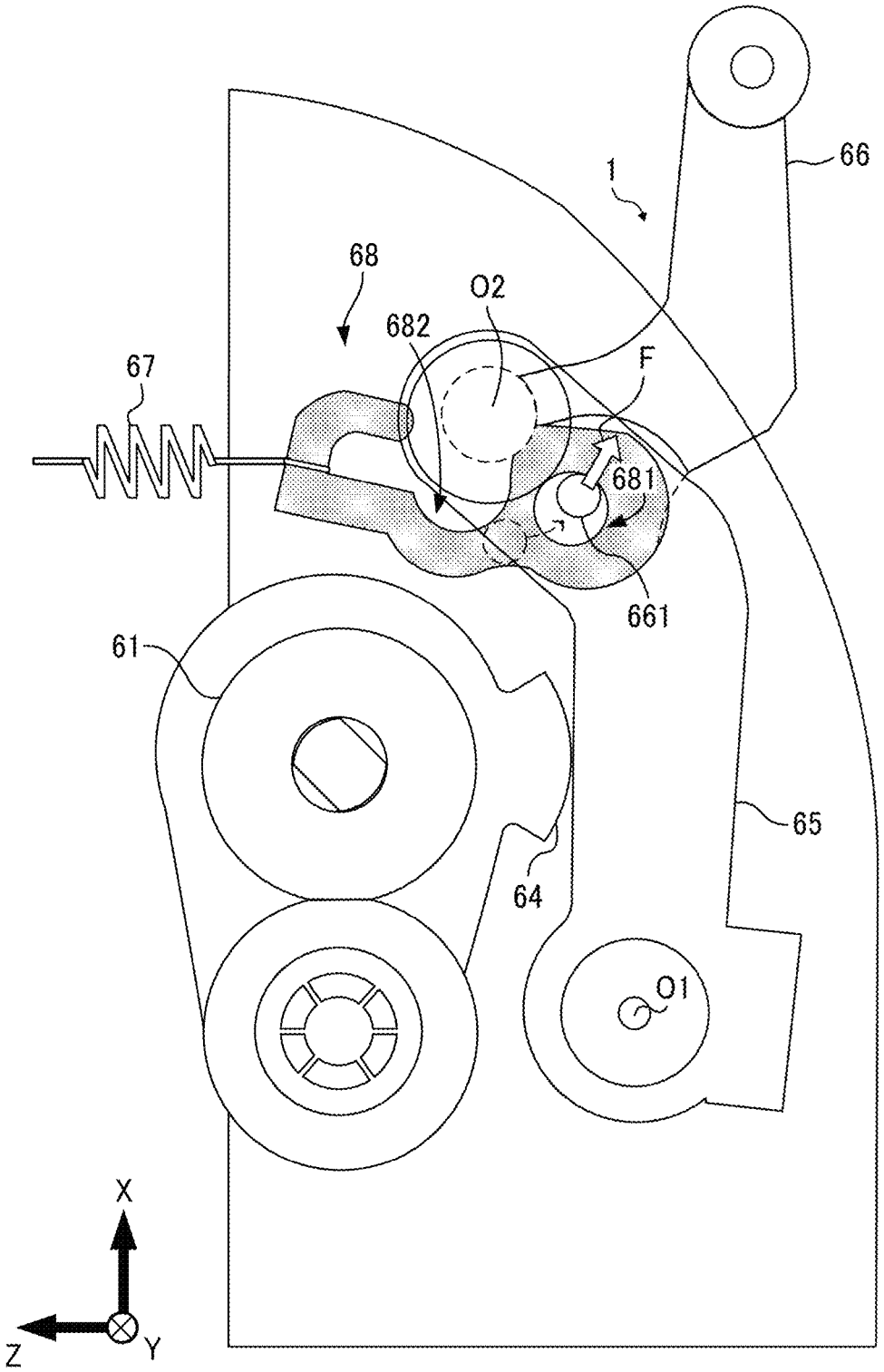
FIG. 8 is a cross-sectional view of the presser depicted in FIG. 2, illustrating one example of transition from the depressurization state to the pressurization state.

As the depressure lever 66 pivots in the direction D depicted in FIG. 7, as illustrated in a dotted line in FIG. 8, for example, the projection 661 also moves in an arc motion in accordance with pivoting of the depressure lever 66. Hence, the projection 661 comes into contact with the inner circumferential wall of the opening 681 at a single point.

As the depressure lever 66 is pressed and pivoted in the direction D depicted in FIG. 7 further from a contact state in which the projection 661 contacts the opening 681, the depressure lever 66 pivots about the second rotation shaft O2 and the projection 661 presses and lifts the inner circumferential wall of the opening 681 in a direction F depicted in FIG. 8, thus pressing up the interlock lever 68.

The hook 683 of the interlock lever 68 is coupled with the case 60 that is stationary through the spring 67. Hence, as the interlock lever 68 is pressed up in the direction F, the interlock lever 68 catches the second rotation shaft O2 such that the recess 682 engages the second rotation shaft O2.

Figure 9:
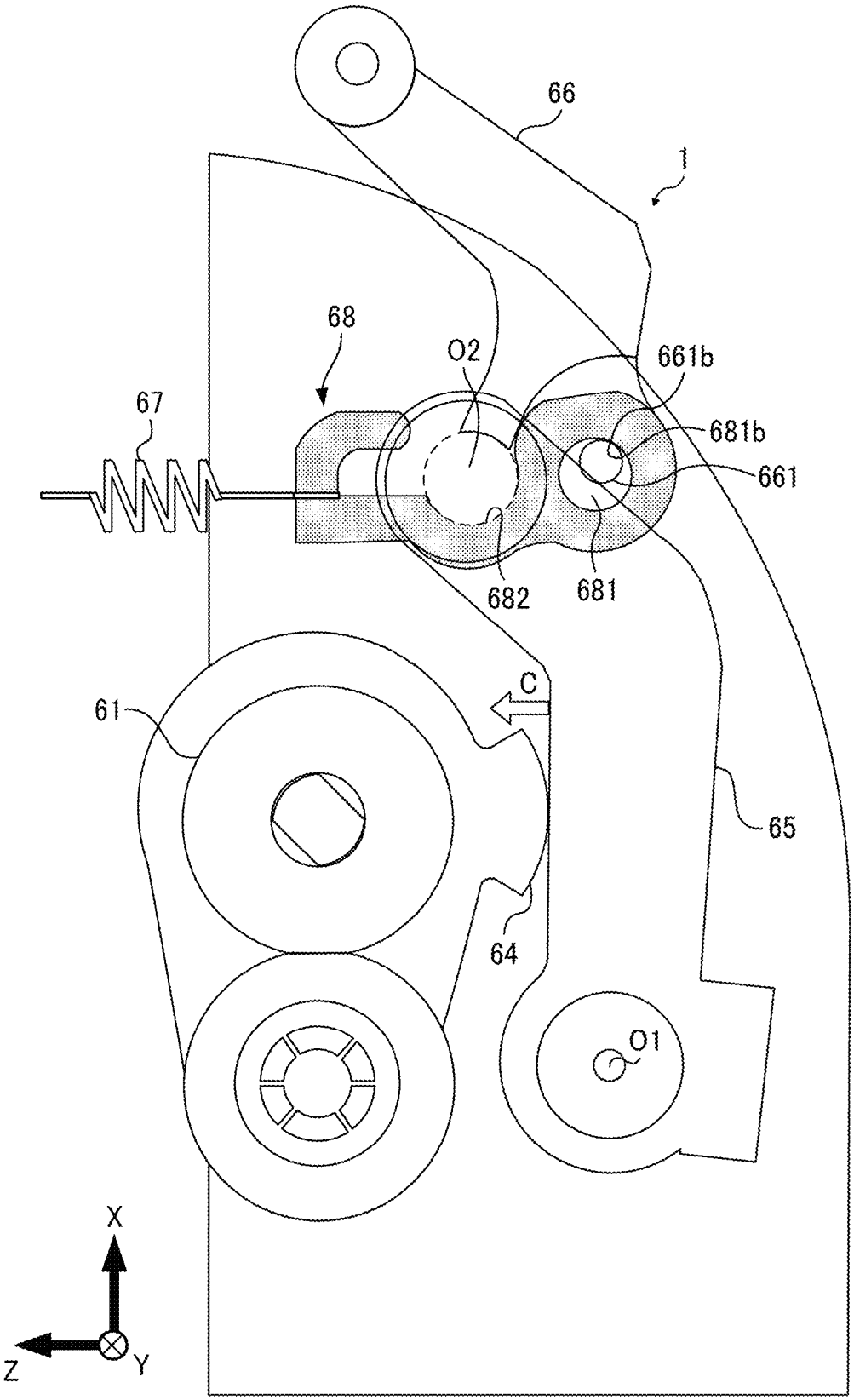
FIG. 9 is a cross-sectional view of the presser depicted in FIG. 2, illustrating one example of the pressurization state.

In a state in which the recess 682 fits the second rotation shaft O2 as illustrated in FIG. 9, the interlock lever 68 pulls the spring 67, stretching the spring 67 and causing the spring 67 to generate a resilient force. Accordingly, the pressure arm 65 presses the pressure body 64 in the direction C. Since the pressure arm 65 is coupled with the depressure lever 66 through the second rotation shaft O2, as long as the second rotation shaft O2 retains engagement with the recess 682, the pressure arm 65 is also secured. Hence, the depressure lever 66, the pressure arm 65, and the interlock lever 68 are secured in a secured state. The pressure arm 65 contacts the pressure body 64 and presses the pressure body 64 in the direction C in a pressurization state that encompasses the secured state.

As described above, the pressure arm 65, the depressure lever 66, the spring 67, and the interlock lever 68 move as illustrated in FIGS. 2, 4A, 4B, 7, 8, and 9, thus constructing the presser 1 that presses the pressure body 64.

As illustrated in FIG. 9, in the fixing device 6 according to this embodiment, in a state in which the depressure lever 66 is pressed down in the Z-direction in an increased amount, the projection 661 contacts the opening 681. However, the fixing device 6 may employ other constructions.

Figure 10:
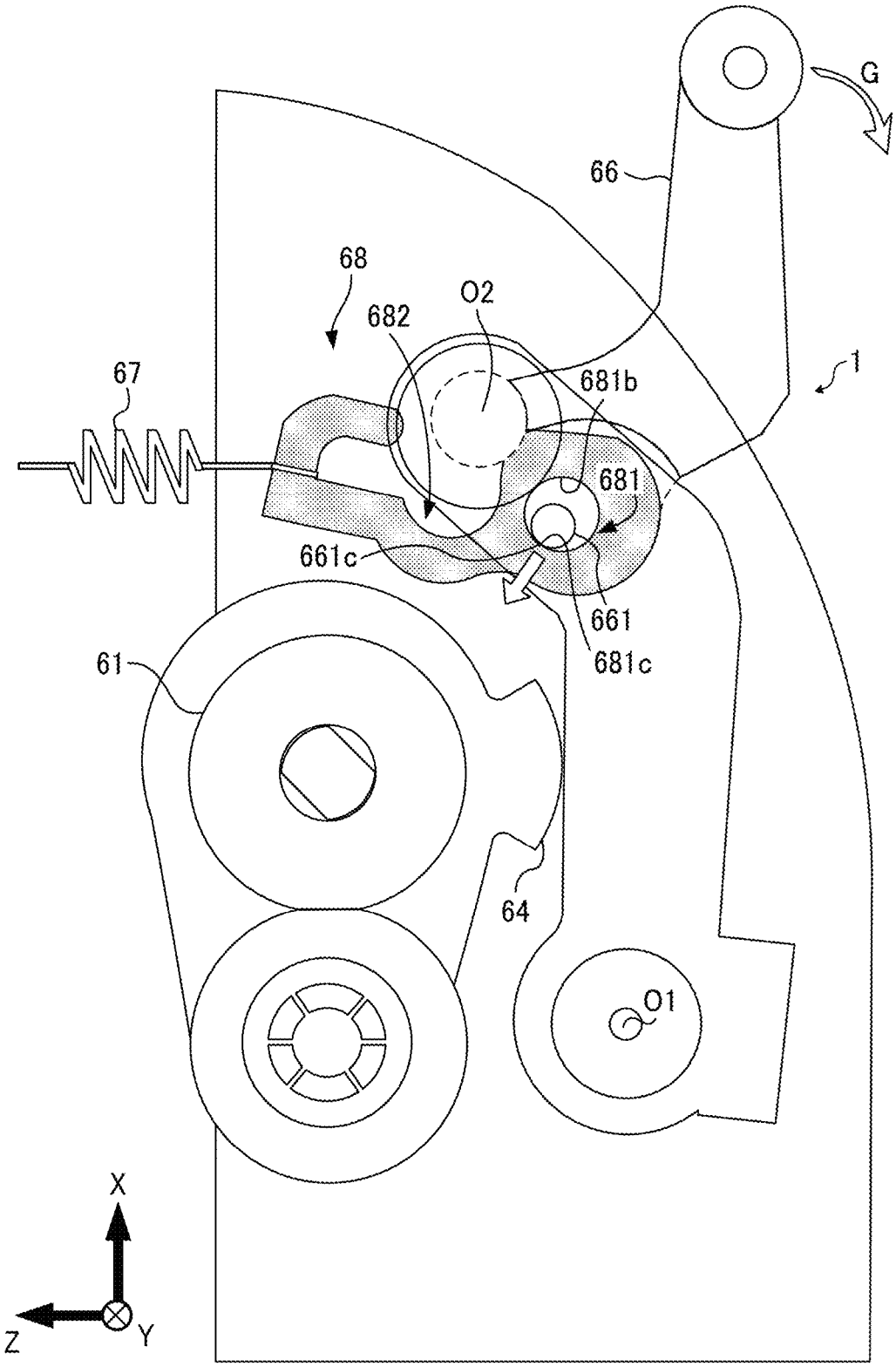
FIG. 10 is a cross-sectional view of the presser depicted in FIG. 2, illustrating one example of transition from the pressurization state to the depressurization state.

Conversely, as the depressure lever 66 is pulled and moved in a direction opposite the Z-direction from the pressurization state, the depressure lever 66 pivots about the second rotation shaft O2. After the projection 661 separates from the opening 681 temporarily, as illustrated in FIG. 10, while the projection 661 contacts an arc portion 681*c* of the inner circumferential wall of the opening 681, that is opposite an arc portion 681*b* thereof where the projection 661 contacts the opening 681 in the pressurization state depicted in FIG. 9, the depressure lever 66 presses down the interlock lever 68 as the depressure lever 66 pivots in a direction G. Thus, the opening 681 has the arc portions 681*b* and 681*c* each of which has a curvature and contacts the projection 661. The projection 661 presses the arc portions 681*b* and 681*c* of the opening 681 to switch between the pressurization state and the depressurization state. The projection 661 includes arc portions 661*b* and 661*c* each of which has a curvature and contacts and presses the opening 681.

When the depressure lever 66 pivots for a predetermined amount or more and engagement between the second rotation shaft O2 and the recess 682 releases, the second rotation shaft O2 moves in the direction opposite the Z-direction and pressure with which the pressure arm 65 presses the pressure body 64 also releases. Thus, the presser 1 returns to the depressurization state depicted in FIG. 2.

FIG. 2 illustrates the depressurization state in which the pressurization state is released and the gap 684 is provided between the projection 661 and the opening 681.

Figure 11:
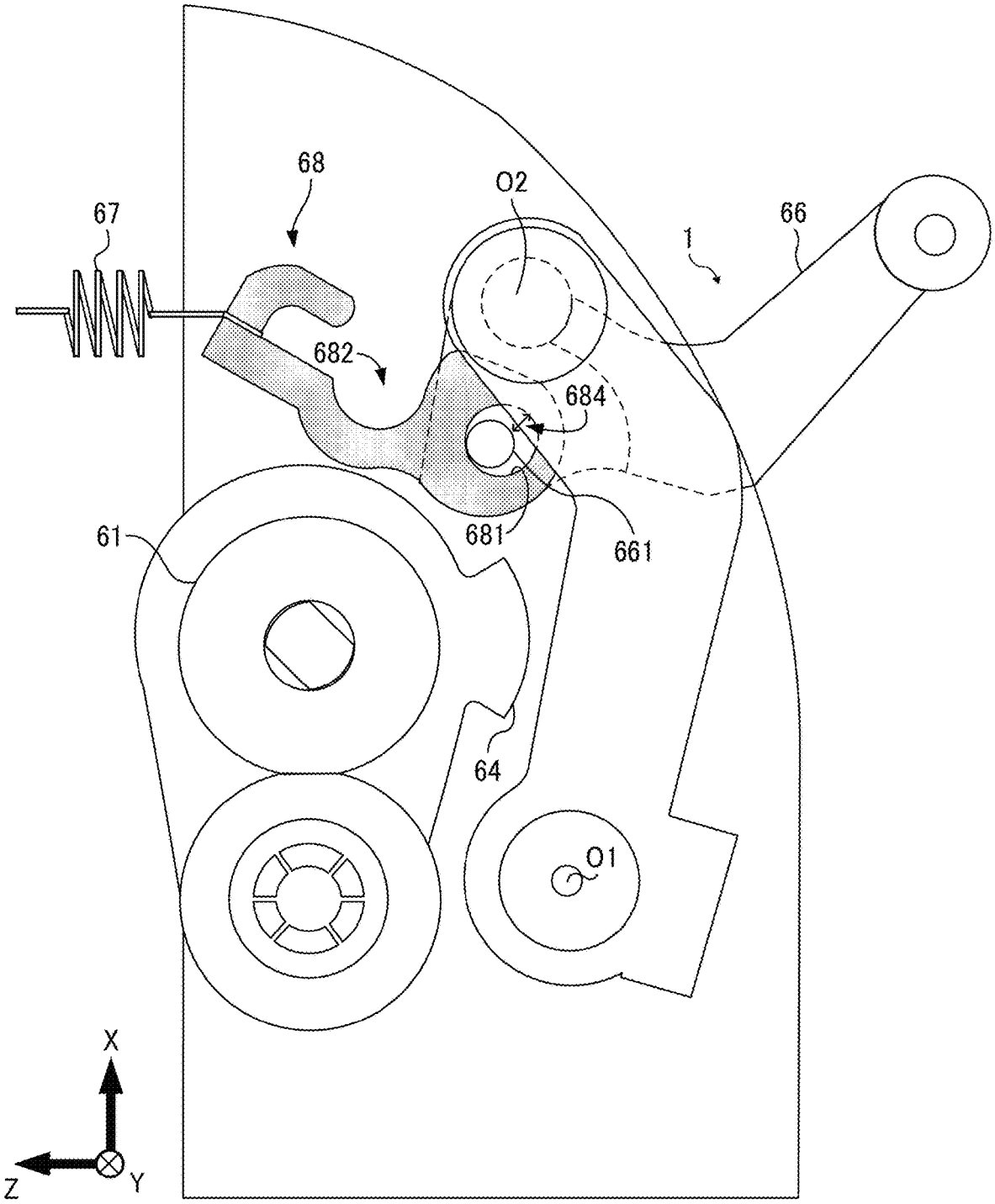
FIG. 11 is a cross-sectional view of the presser depicted in FIG. 2, illustrating another example of the depressurization state.

The gap 684 defines an interval produced in a moving direction F depicted in FIG. 8 in which the projection 661 moves in accordance with pivoting of the depressure lever 66 to transit from the depressurization state to the pressurization state. For example, as illustrated in FIG. 11, even if the projection 661 contacts the opening 681, the gap 684 may be produced.

As illustrated in FIG. 2, the fixing device 6 according to this embodiment includes the pressure arm 65 that presses at least one of the first fixing rotator 61 and the second fixing rotator 62 serving as a pair of nip formers disposed opposite each other. The predetermined, first rotation shaft O1 supports the pressure arm 65 such that the pressure arm 65 is pivotable about the first rotation shaft O1. The depressure lever 66 contacts the pressure arm 65. The predetermined, second rotation shaft O2 supports the depressure lever 66 such that the depressure lever 66 is pivotable about the second rotation shaft O2 with respect to the pressure arm 65.

In the fixing device 6 according to this embodiment, the depressure lever 66 includes the projection 661. The interlock lever 68 includes the opening 681 that is greater than the projection 661. As the depressure lever 66 pivots, the projection 661 comes into contact with and separates from the opening 681 of the interlock lever 68. The interlock lever 68 further includes the recess 682 that engages the second rotation shaft O2 as the depressure lever 66 pivots.

As illustrated in FIGS. 4A and 4B, the width $r_0$ of the decreased width portion 681*a* of the opening 681 is greater than the width $r_w$ of the increased width portion 661*a* of the projection 661, that engages the opening 681.

Accordingly, a slide resistance between the opening 681 and the projection 661 that slides over the opening 681 does not decrease a force exerted to the depressure lever 66 by the operator. Hence, the force exerted by the operator is transmitted to the pressure arm 65 without being decreased. Thus, the pressure arm 65 switches between the pressurization state and the depressurization state with a decreased force.

According to this embodiment, the opening 681 defines a circle having a diameter greater than a diameter of the projection 661.

Accordingly, the simple shape of each of the opening 681 and the projection 661 facilitates motion of the interlock lever 68 as the interlock lever 68 transits from the pressurization state to the depressurization state. Accordingly, the slide resistance between the opening 681 and the projection 661 that slides over the opening 681 does not decrease the force exerted to the depressure lever 66 by the operator. Hence, the force exerted by the operator is transmitted to the pressure arm 65 without being decreased. Thus, the pressure arm 65 switches between the pressurization state and the depressurization state with a decreased force.

According to this embodiment, the interlock lever 68 achieves two states, that is, the pressurization state and the depressurization state. The pressurization state includes the secured state in which the recess 682 engages the second rotation shaft O2. In the depressurization state, the pressurization state is canceled. In the pressurization state, the projection 661 contacts the opening 681. In the depressurization state, the gap 684 is provided between the projection 661 and the opening 681.

The gap 684 is produced in the moving direction F depicted in FIG. 8 in which the projection 661 moves in accordance with pivoting of the depressure lever 66 to transit from the depressurization state to the pressurization state. Accordingly, the slide resistance between the opening 681 and the projection 661 that slides over the opening 681 does not decrease the force exerted to the depressure lever 66 by the operator. Hence, the force exerted by the operator is transmitted to the pressure arm 65 without being decreased. Thus, the pressure arm 65 switches between the pressurization state and the depressurization state with a decreased force.

The above describes the embodiments of the present disclosure. However, the technology of the present disclosure is not limited to the specific embodiments and allows various deformation and modification within the scope of the present disclosure unless the above descriptions limit deformation and modification.

For example, according to the embodiments of the present disclosure, the presser 1 is installed in the fixing device 6 as a part of the image forming apparatus 100. Alternatively, the presser 1 may be provided separately from the fixing device 6 or may be installed in devices other than the fixing device 6.

Advantages of the above-described embodiments of the present disclosure denote appropriate advantages achieved by the technology of the present disclosure and are not limited to those of the above-described embodiments of the present disclosure.

A description is provided of advantages of a presser (e.g., the presser 1).

As illustrated in FIG. 2, the presser includes a pressurizing portion (e.g., the pressure arm 65), a first rotation shaft (e.g., the first rotation shaft O1), a depressurizing portion (e.g., the depressure lever 66), a second rotation shaft (e.g., the second rotation shaft O2), and an interlock lever (e.g., the interlock lever 68).

The pressurizing portion presses at least one of a pair of nip formers or a pressed object (e.g., at least one of the first fixing rotator 61 and the second fixing rotator 62). The nip formers are disposed opposite each other. The first rotation shaft supports the pressurizing portion such that the pressurizing portion is pivotable about the first rotation shaft. The second rotation shaft supports the depressurizing portion such that the depressurizing portion is pivotable about the second rotation shaft with respect to the pressurizing portion. The depressurizing portion includes an engagement (e.g., the projection 661). The interlock lever includes an opening (e.g., the opening 681) that engages the engagement. The depressurizing portion pivots to cause the engagement to contact and press the opening so as to switch between a pressurization state in which the pressurizing portion presses the nip former and a depressurization state in which the pressurization state is released. As the depressurizing portion pivots to switch from the depressurization state to the pressurization state and from the pressurization state to depressurization state, the depressurizing portion defines a gap (e.g., the gap 684) between the engagement and the opening in a moving direction (e.g., the moving direction F depicted in FIG. 8) in which the engagement moves.

Accordingly, the engagement and the opening decrease a force that switches between the pressurization state and the depressurization state.

According to the embodiments described above, the first fixing rotator 61 is the pressure roller. Alternatively, the first fixing rotator 61 may be a pressure belt or the like. Further, the second fixing rotator 62 is the fixing belt. Alternatively, the second fixing rotator 62 may be a fixing roller, a fixing film, a fixing sleeve, or the like.

According to the embodiments described above, the presser 1 is installed in the fixing device 6. Alternatively, the presser 1 may be installed in devices other than the fixing device 6. In this case, the pressed object is not limited to the nip formers (e.g., the pressure roller, the pressure belt, the fixing belt, the fixing roller, the fixing film, and the fixing sleeve).

According to the embodiments described above, the image forming apparatus 100 is a copier. Alternatively, the image forming apparatus 100 may be a printer, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A presser configured to press a pressed object, the presser comprising:

a first rotation shaft;

a pressurizing portion supported by the first rotation shaft and configured to pivot about the first rotation shaft;

a second rotation shaft;

an interlock lever including a circular opening having a first diameter; and a depressurizing portion supported by the second rotation shaft and configured to pivot about the second rotation shaft with respect to the pressurizing portion, the depressurizing portion including a projection penetrating the opening, a widest portion of the projection having a second diameter sufficiently smaller than the first diameter such that a gap exists in all directions between the projection and the opening when the presser is in a depressurizing state to allow the projection to move the set distance within the circular opening and, as the depressurizing portion pivots to switch the presser from the depressurizing state to a pressurization state, the projection freely moves a set distance within the circular opening before the presser is in the pressurization state in which the projection contacts and presses the opening to cause the pressurizing portion to press the pressed object.

2. The presser according to claim 1, wherein the opening defines a circle having a diameter greater than a diameter of the projection.

3. The presser according to claim 1, wherein the interlock lever further includes a recess configured to engage the second rotation shaft as the depressurizing portion pivots.

4. The presser according to claim 3, wherein the recess is configured to engage the second rotation shaft to secure the interlock lever in the pressurization state.

5. The presser according to claim 3, further comprising:

a spring to which the interlock lever is anchored, wherein the interlock lever is configured to engage the second rotation shaft and the depressurizing portion.

6. The presser according to claim 5, wherein the interlock lever further includes a hook extending from the recess, the hook configured to be hooked with the spring.

7. The presser according to claim 1, wherein at least one of the projection and the opening includes an arc portion having a curvature.

8. The presser according to claim 7, wherein the projection is configured to contact and press the opening at the arc portion.

9. The presser according to claim 1, wherein the second diameter is sufficiently smaller than the first diameter such that, in at least a direction in which a force is exerted on the opening and the projection as the depressurizing portion pivots, the gap exists between the projection and the opening when the presser is in the depressurizing state to allow the projection to move the set distance within the circular opening in the direction of the force.

10. A fixing device comprising:

a first nip former;

a second nip former disposed opposite the first nip former to form a fixing nip between the first nip former and the second nip former, the fixing nip through which a recording medium bearing an image is conveyed; and a presser configured to press at least one of the first nip former and the second nip former, the presser including:

a first rotation shaft;

a pressurizing portion supported by the first rotation shaft and configured to pivot about the first rotation shaft;

a second rotation shaft;

an interlock lever including a circular opening having a first diameter; and a depressurizing portion supported by the second rotation shaft and configured to pivot about the second rotation shaft with respect to the pressurizing portion, the depressurizing portion including a projection penetrating the opening, a widest portion of the projection having a second diameter sufficiently smaller than the first diameter such that a gap exists in all directions between the projection and the opening when the presser is in a depressurizing state to allow the projection to move the set distance within the circular opening and, as the depressurizing portion pivots to switch the presser from the depressurizing state to a pressurization state, the projection freely moves a set distance within the circular opening before the presser is in the pressurization state in which the projection contacts and presses the opening to cause the pressurizing portion to press the at least one of the first nip former and the second nip former and a depressurization state in which the pressurization state is released.

11. The fixing device according to claim 10, further comprising a pressure body mounted on the first nip former and configured to press the first nip former, the pressure body configured to be pressed by the pressurizing portion.

12. The fixing device according to claim 10, wherein the first nip former includes a pressure roller.

13. The fixing device according to claim 10,
wherein the second nip former includes a fixing belt.

14. The fixing device according to claim 10,
wherein the pressurizing portion includes a pressure arm.

15. The fixing device according to claim 10,
wherein the depressurizing portion includes a depressure lever.

16. The fixing device according to claim 10, wherein the second diameter is sufficiently smaller than the first diameter such that, in at least a direction in which a force is exerted on the opening and the projection as the depressurizing portion pivots, the gap exists between the projection and the opening when the presser is in the depressurizing state to allow the projection to move the set distance within the circular opening in the direction of the force.

17. An image forming apparatus comprising:
an image bearer configured to bear an image; and
a fixing device configured to fix the image on a recording medium, the fixing device including:
a first nip former;
a second nip former disposed opposite the first nip former to form a fixing nip between the first nip former and the second nip former, the fixing nip through which the recording medium bearing the image is conveyed; and
a presser configured to press at least one of the first nip former and the second nip former, the presser including:
a first rotation shaft;
a pressurizing portion supported by the first rotation shaft and configured to pivot about the first rotation shaft;
a second rotation shaft;
an interlock lever including a circular opening having a first diameter; and
a depressurizing portion supported by the second rotation shaft and configured to pivot about the second rotation shaft with respect to the pressurizing portion, the depressurizing portion including a projection penetrating the opening, a widest portion of the projection having a second diameter sufficiently smaller than the first diameter such that a gap exists in all directions between the projection and the opening when the presser is in a depressurizing state to allow the projection to move the set distance within the circular opening and, as the depressurizing portion pivots to switch the presser from the depressurizing state to a pressurization state, the projection freely moves a set distance within the circular opening before the presser is in the pressurization state in which the projection contacts and presses the opening to cause the pressurizing portion to press the at least one of the first nip former and the second nip former.

18. The image forming apparatus according to claim 17, wherein the second diameter is sufficiently smaller than the first diameter such that, in at least a direction in which a force is exerted on the opening and the projection as the depressurizing portion pivots, the gap exists between the projection and the opening when the presser is in the depressurizing state to allow the projection to move the set distance within the circular opening in the direction of the force.

* * * * *